United States Patent [19]

Nakano

[11] 4,280,744

[45] Jul. 28, 1981

[54] FOLDABLE DESK

[76] Inventor: Yutaka Nakano, No. 24-17, Nakamachi 3-chome, Musashino-shi, Tokyo, Japan

[21] Appl. No.: 38,901

[22] Filed: May 14, 1979

[30] Foreign Application Priority Data

| | | | |
|---|---|---|---|
| Feb. 11, 1978 | [JP] | Japan | 53-151139[U] |
| Jul. 11, 1978 | [JP] | Japan | 53-153313[U] |
| Sep. 6, 1978 | [JP] | Japan | 53-122204[U] |
| Mar. 26, 1979 | [JP] | Japan | 54-38868[U] |

[51] Int. Cl.[3] ..... A47B 85/00

[52] U.S. Cl. ..... 312/240; 5/503; 108/19; 312/313

[58] Field of Search ..... 312/237, 240, 241, 313–317; 108/10, 19; 5/503, 507

[56] References Cited

U.S. PATENT DOCUMENTS

| | | | |
|---|---|---|---|
| 2,880,047 | 3/1959 | Haag | 108/19 |
| 3,063,736 | 11/1962 | Landig | 5/503 |
| 3,201,186 | 8/1965 | Noonan et al. | 312/241 |
| 4,058,355 | 11/1977 | Stahl et al. | 312/241 |

*Primary Examiner*—Casmir A. Nunberg

*Attorney, Agent, or Firm*—Lane, Aitken, Ziems, Kice & Kananen

[57] ABSTRACT

Disclosed is a foldable desk or table comprising a support frame having pivotal support portions in the upper portions of the riser portion thereof, a single rectangular top plate of a length greater than the height of the pivotal support portions from a floor surface and swingably supported on the pivotal support portions to have a pivotal line across the width and at a position closer to the base end thereof, the pivotal line defining a swinging length of the top plate slightly shorter than the height of the pivotal support portions, and a leg swingably connected to the underside of the top plate at the outer free end thereof, the leg member being folded onto the underside of said top plate when the outer free end of the top plate is rotated about the pivotal line into a vertical folded position. Also disclosed is a foldable desk usable as a bed desk by providing an auxiliary leg in addition to the main leg.

14 Claims, 14 Drawing Figures

FOLDABLE DESK

BACKGROUND OF THE INVENTION (1) Field of the Invention

This invention relates to foldable desks or tables and more particularly to a foldable desk with a pivotally supported top plate.

The desks or tables to be used in offices, hotels or hospitals or to be kept in the household for supplemental use are desired to be foldable into a compact shape from the standpoint of reducing the space of storage which is required when they are not used.

The foldable desks are generally required to be easy to fold and set up, stable in folded and set-up state, and compact when folded. In addition, the desks have to be easy to carry to the places where they are needed.

(2) Description of the Prior Art

One type of known foldable desks employ a foldable top plate consisting of a number of plate sections which are connected with each other by hinges or similar means. This type of foldable desks are easy to handle when folding or unfolding the top plate and can be folded into a compact form. A detrimental drawback inherent to such top plate is that the hinged joints have so small a resistance to a load that care has to be taken when folding and unfolding the top plate not to damage its joints. In addition, its fabrication process is complicated due to the necessity for jointing the respective top plate sections and supporting them on a horizontal plane.

Those problems can be solved by using a top plate of a single piece which is supported rotatably about a horizontal axis for rotation between folded and unfolded positions. In such a case, it is preferred that, in unfolding the desk, the top plate is rotated downward from the standpoint of easiness of handling and stability especially in a case where the desk is to be moved for use in various places without being fixedly installed in a particular place.

In rotating a top plate into a vertical folded position from a horizontal unfolded position or vice versa, a wide space is required where the axis of rotation lies along the length of the top plate. On the other hand, a top plate which has an axis of rotation across its width can have only a limited length since the outer end of a lengthy top plate will hit on the floor to block further rotation in the middle of the folding operation. Moreover, a top plate with the axis of rotation crosswise at a median point between its opposite ends has a difficulty in stability during use and in folded state.

With the foregoing in view, the present invention has as its object the provision of a foldable desk which is easy to handle when folding and unfolding the top plate and which can be folded into a compact form.

It is another object of the present invention to provide a foldable desk employing a top plate which is foldable by downward rotation about a crosswise axis located closer to one end of the top plate, which top plate being foldable flat on a frame to occupy an extremely small floor space.

It is still another object of the present invention to provide a foldable desk employing a lengthy top plate which is pivotally supported on a support frame at a position between its opposite ends and rotatable downward into a folded position.

It is a further object of the present invention to provide a foldable desk employing a top plate which has a crosswise axis of rotation at a position closer to one end thereof.

It is a further object of the present invention to provide a foldable desk which employs at one end of the top plate a support frame with a substantial width in the horizontal direction and at the other end a leg which is foldable onto the top plate.

It is a supplemental object of the present invention to provide a foldable desk which has, a short leg at the outer end of the top plate in addition to a main leg of an ordinary length to serve as an ordinary desk also as a bed desk.

SUMMARY OF THE INVENTION

The foregoing objects of the present invention are achieved by the provision of a foldable desk comprising: a support frame having a pair of riser portions erected in parallel relation on a base portion and provided with pivotal support portions in the upper portions of the riser portions; a top plate consisting of a single rectangular plate of a length greater than the height of the pivotal support portions from a floor surface and swingably supported on the pivotal support portions to have a pivotal line across the width and at a position closer to the base end thereof, the pivotal line defining a swinging length of the top plate slightly shorter than the height of the pivotal support portions; and a leg member having the upper end thereof swingably connected to the underside of the top plate at the outer free end thereof; the leg member being folded onto the underside of the top plate when the outer free end of the top plate is rotated about the pivotal line into a vertical folded position.

The foldable desk of this construction allows use of a relatively lengthy and wide top plate, and is easy to fold and unfold in a stable manner and foldable into a compact form which can be easily handled when moving from one place to another. A short auxiliary leg may be provided at the outer free end of the top plate in addition to a main leg to use the desk on a bed or for other purposes. In such a case, the main leg is held in folded position and the auxiliary leg is unfolded to stand on the bed or on other elevated surface to hold the top plate at a level suitable for use in bed.

BRIEF DESCRIPTION OF THE DRAWINGS

The above and other objects, features and advantages of the present invention will become apparent from the following description and the appended claims, taken in conjunction with the accompanying drawings which show by way of example preferred embodiments of the present invention and in which:

DESCRIPTION OF PREFERRED EMBODIMENTS

Figure 1:
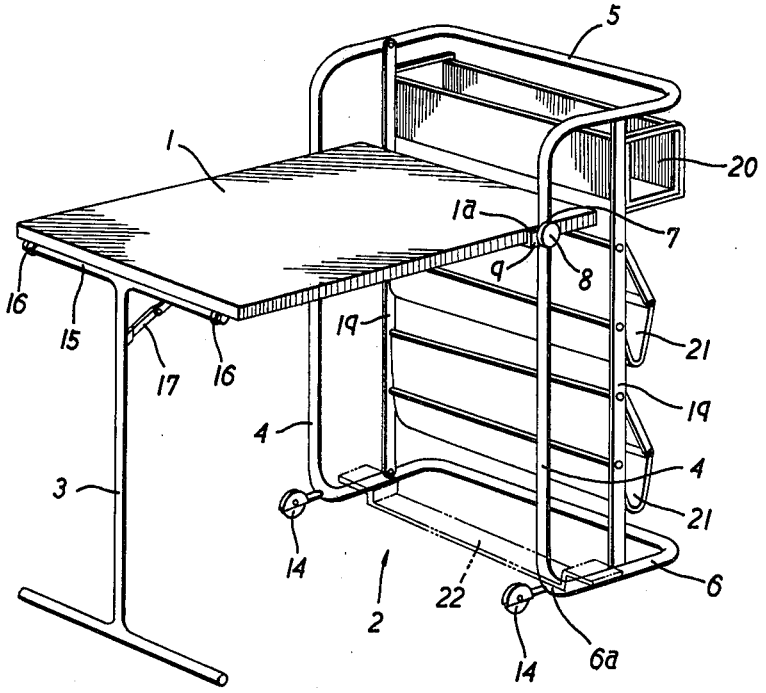
FIG. 1 is a perspective view of a foldable desk according to the present invention.
Figure 2:
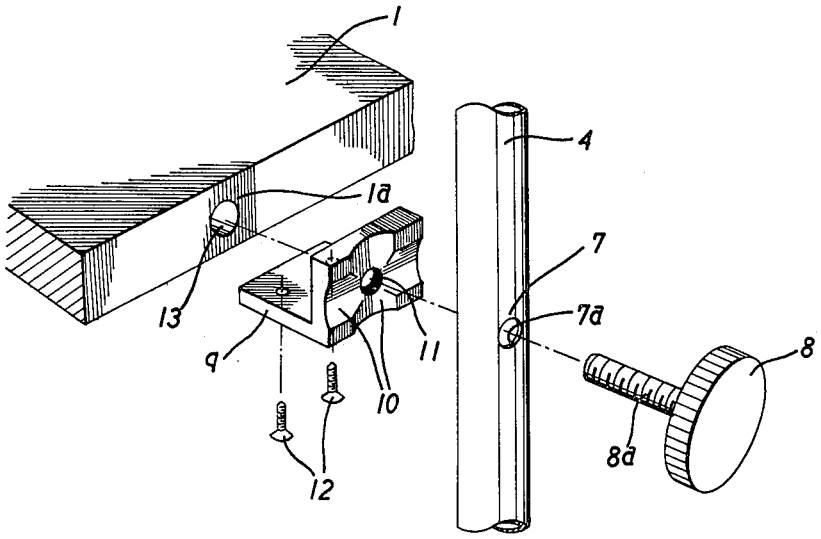
FIG. 2 is a fragmentary exploded view showing on an enlarged scale the manner in which the top plate of the desk is pivotally connected to a support.
Figure 3:
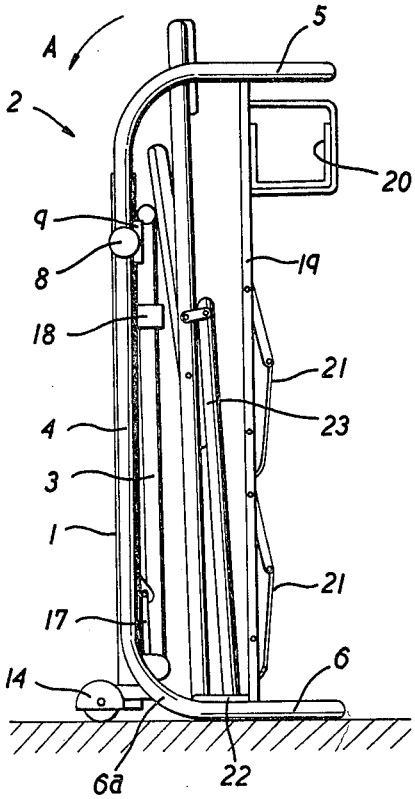
FIG. 3 is a side view of the desk of FIG. 1 as in folded state.

Referring to FIGS. 1 to 3, there is shown a foldable desk according to the present invention, which includes a rectangular top plate 1, a support frame 2 which supports the base end of the top plate 1, and a leg member 3 which is attached to the fore end of the top plate 1. The support frame 2 consists of a metal pipe forming two vertical side frames 4 which are spaced from each other and integrally connected to U-shaped top and base frames 5 and 6 at the upper and lower ends thereof. The top plate 1 is rotatably supported on the side frames 4 by pivoting screw members 8 at pivotal support portions 7 in the upper portions of the side frames 4. The screw member 8 determine a pivotal axis across the width of the top plate 1 and are each threaded into a bore 7*a* which is provided at the pivotal support portion 7 and then into an angular metal attachment 9 which is fixed to a pivotal point 1*a* at each side of the top plate 1. As shown in FIG. 2, the metal attachment 9 is provided on the outer side thereof with crossed longitudinal and transverse grooves 10 which are shaped to fit on the vertical side frame 4 at the pivotal support portion 7, and centrally with a screw hole 11 which receives the threaded bolt 8*a* of the pivoting screw member 8. The metal attachment 9 is securely attached to the pivotal point 1*a* at each side of the top plate 1 by suitable means such as screws 12. In FIG. 2, the reference numeral 13 designates an escape hole which is provided at the pivotal point of the top plate 1. Therefore, upon tightening the screw member 8 after fitting either the longitudinal or transverse groove 10 of the metal attachment 9 on the pivotal support portion of the vertical frame 4, the top plate 1 is fixed to the vertical frame 4 in the unfolded horizontal position of FIG. 1 or in the folded vertical position of FIG. 3.

Thus, it is possible to employ a top plate 1 which is longer than the distance between the floor surface and the support point 1*a* on the vertical frame 4. The top plate 1 is pivotally supported on the support frame 2 at pivotal points which are located at opposite sides and closer to one end of the plate 1. The pivotal point is located such that the distance between the pivotal point and the other free end of the plate 1 is shorter than the distance between the height of the pivotal support portion 7 on each vertical frames 4. At the pivotal points 1*a*, the top plate 1 is rotatably supported on the vertical frames 4 by pivoting screw member 8, the outer free end of the top plate thus being rotatable downward to assume the folded vertical position as shown in FIG. 3 when not used.

In order to ensure the stability of the top plate in the unfolded and folded position, it is preferred to locate the pivotal points 1*a* as close to the base end of the top plate as possible so that the plate length between its outer free end and the pivotal points is slightly smaller than the height of the support point 7 on the vertical frames 4.

In addition, it is preferred to provide casters 14 at the arcuately bent portions 6*a* between the vertical frames 4 and the U-shaped base frame 6 thereby preventing the support frame 2 from tilting along the arcuately bent portions 6*a*. The casters 14 are projected away from the arcuately bent portions 6*a* to run on the same level as the underside of the base frame 6.

The leg member 3 has at its upper end a transversely extending support rod 15 which is rotatably supported within bearings 16 which are fixed on the underside of the top plate 1. A foldable support arm 17 is provided between the top plate 1 and the leg member 3, which is stretched to hold the leg member 3 in upright position when the desk is used. For folding the desk, the leg member 3 is folded toward the underside of the top plate 1 and snapped in a U-shaped holder 18 of a leaf spring which is fixed on the underside of the top plate 1.

Vertical mounting frames 19 are opposingly fixed between the top and base frames 5 and 6 of the support frame 2. If desired, trays 20 or racks 21 may be attached to the frames 19 to put in small articles such as writing implements, postage stamps, magazines, writing pads and the like since it is relatively difficult to provide drawers on a foldable desk.

In use of the above-described desk, the top plate 1 is unfolded into the horizontal position shown in FIG. 1 to serve as an ordinary desk.

When the desk is not necessary, the leg member 3 is folded onto the underside of the top plate 1 and the fore free end of the top plate 1 is rotated downward into the folded vertical position. At this time, although the top plate 1 is longer than the height of the support portions 7, the fore free end of the top plate does not hit on the floor surface since the pivotal points 1*a* which determines the swinging length of the top plate is located a certain distance outward of the base end of the top plate 1.

Except the top plate 1 of wooden material, the foldable desk can be formed from metal pipes or other material of relative light weight so that it can be easily carried from one place to another by tilting the support frame 2 and folded top plate 1 in the direction of arrow A of FIG. 3 to have the whole structure supported on the casters 14.

In the particular embodiment shown, a bottom plate 22 is bridged on and between the opposite arms of the base frame 6 so that a chair 23 which forms a pair with the foldable desk can be put away in the space between the folded top plate 1 and the mounting frames 19, thereby minimizing the dead space in the folded structure and allowing to carry the chair together with the desk in the event of its removal.

Figure 4:
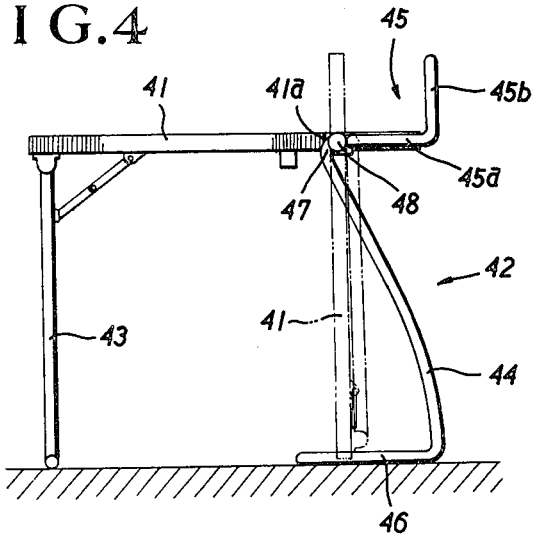
FIG. 4 is a side view of a similar but partly modified foldable desk according to the present invention.

FIG. 4 shows another embodiment of the invention, which employs a support frame 42 of a different shape. The support frame 42 has two tilted riser frames 44 which are connected at the respective lower ends to a U-shaped base frame 46 which extends toward a leg member 43. The upper ends of the tilted riser frames 44 are connected to an angular top frame 45 forming a horizontal portion 45*a* and a vertical portion 45*b* on each riser frame 44. The top plate 41 is pivotally supported at pivotal points 41*a* at opposite sides thereof by a screw member 48 which is threaded into a pivotal support portion 47 at the base end of each horizontal portion 45*a* of the top frame 45.

In the actual use of a desk, a worker generally uses only a limited area of the top plate 1, for instance, an area necessary for putting a writing pad or some books, placing unimportant articles on the peripheral or corner areas of the top plate. Therefore, the worker will not experience inconvenience even in the embodiment of FIGS. 1 to 3 which has the bent top frame 5 projected over the end portion of the top plate 1. However, the worker can have more easy access to the corners at the base end of the top plate 41 in the embodiment of FIG. 4 where the top frame 45 has horizontal portions 45*a* which extends as far as the base end of the top plate 41. In addition, the support frame 42 of the embodiment of FIG. 4 has tilted riser frames 44 so that there is no possibility of the worker's finger or fingers being nipped between the riser frames 44 and the top plate 41 which has been brought to the position indicated in phantom in FIG. 4.

Figure 5:
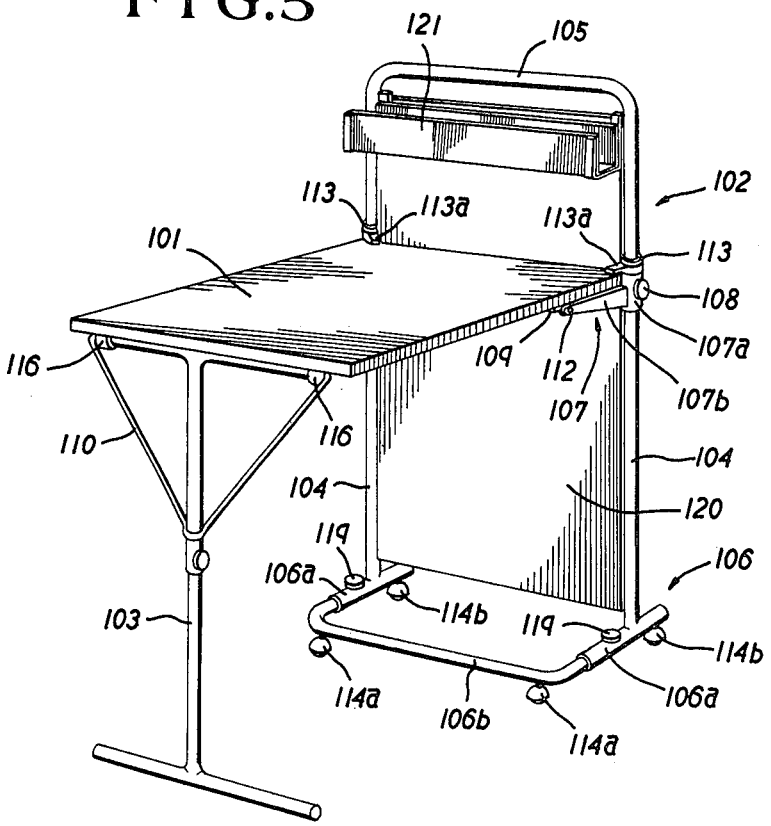
FIG. 5 is a perspective view of another embodiment of the present invention.
Figure 6:
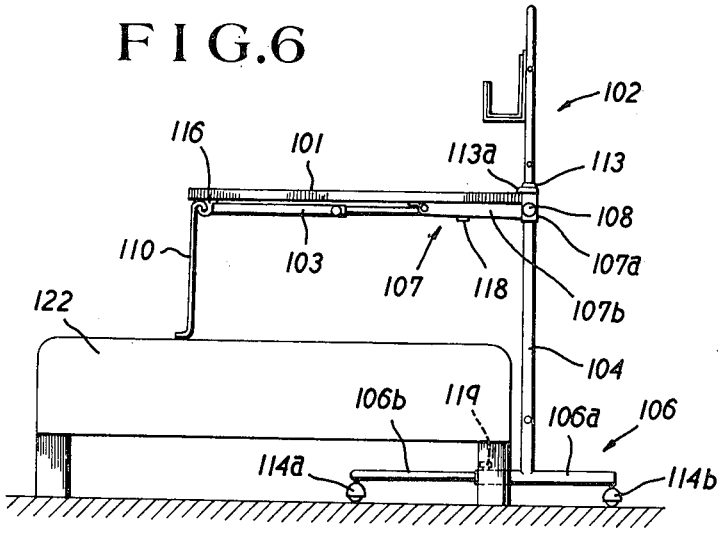
FIG. 6 is a side view of the foldable desk of FIG. 5 serving as a bed desk.
Figure 7:
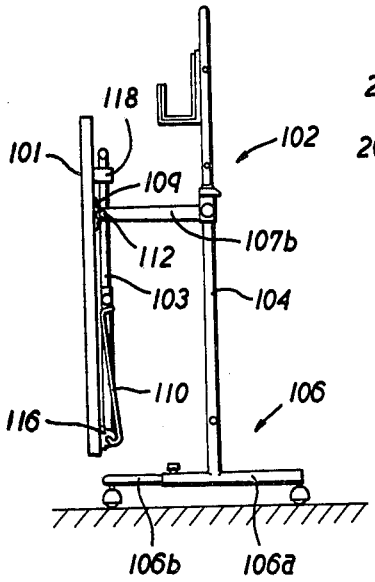
FIG. 7 is a side view of the desk of FIG. 5 as in folded state.

FIGS. 5 through 7 illustrate a third embodiment of the present invention, which can serve as a bed desk or for other purposes in addition to an ordinary desk.

Referring to FIG. 5, the foldable desk has a support frame 102 which consists of a pair of vertical frames 104, a top frame 105 connecting upper ends of the vertical frames 104, and a base frame 106 supporting the vertical frames 104 in the upright positions. Slidably fitted on the paired vertical frames 104 are adjust rings 107*a* of brackets 107*b* which have the pivotal support portions at the respective outer ends distant from the vertical frames 104. The adjust rings 107*a* of the brackets 107*b* can be fixed at a desired level on the respective vertical frames 104 by tighting screws 108. The top plate 101 is rotatably supported on the brackets 109 by pins 112 which engage metal pieces 109 which are attached to opposite sides of the top plate at transversely aligned positions closer to the base end thereof.

The top plate 101 has at its fore free end a leg member 103 the length of which is telescopically adjustable. The member 103 has its upper end a transversely extending support rod which is rotatably held in bearings 116 which are fixed on the underside of the top plate 101, connecting the leg member 103 swingably toward and away from the top plate 101. Similarly foldably attached to the underside of the top plate 1 is an auxiliary leg member 110 which also serves as a stopper for maintaining the main leg member 103 in the unfolded upright position. The top plate is also provided on its underside a holder member 118 (FIG. 6) which resiliently holds the main leg member 103 in the folded position. The auxiliary leg member 110 is attached to the bearings 116 in such a manner as to be resiliently held in the unfolded position of FIGS. 5 and 6 or in the folded position of FIG. 7 by its own resiliency. For the purpose of ensuring stability of the top plate 101 during use, holder rings 113 with hold arms 113*a* are fitted on the vertical frames 104 for swivelling movement on the upper ends of the adjust rings 107*a*. By bringing the arms 113*a* of the holder rings 113 into abutting engagement with the upper surface of the top plate, the base end of the latter is stably gripped between the arms 113*a* of the holder ring 113 and the brackets 107*b* in the position of FIG. 5 during use of the desk.

The base frame 106 of the support frame 102 consists of foot pipes 106*a* which are secured to the lower ends of the respective vertical frames 104 and a substantially U-shaped toe link 106*b*. The opposite ends of the toe link 106*b* is slidably fitted into the foot pipe 106*a*. The toe link 106*b* is therefore telescopically movable into and out of the foot pipes 106*a* and fixed in an arbitrary position by screws 119. The toe link 106*b* and foot pipes 106*a* are provided with casters 114*a* and 114*b*, respectively. Designated at 120 is a panel board which is mounted between the vertical frames 104 and at 121 is a tray which is mounted on the frames 104.

The desk of the above-described construction can be used in an arbitrary place as an ordinary desk by unfolding the top plate 101 and the leg member 103 into the positions shown in FIG. 5. In this instance, the toe link 106*b* is fixed in a fully inserted or contracted position in the foot pipes 106*a*. The height of the top plate 101 is adjustable by shifting the adjust rings 107*a* to a desired level and stretching or shrinking the main leg 103.

In order to use the desk on a bed, it is moved to bed side as shown in FIG. 6, and the main leg is folded into the holder member 118, instead swinging out the auxiliary leg 110 to stand on the bed 122. In this instance, it is preferred to fully stretch out the toe link 106*b* of the base frame 106 under the bed 122 to prevent the support frame 102 from tilting toward the top plate 101 and to support the desk in a stable state.

When the desk is not used, the main and auxiliary legs 103 and 110 are folded and the holder rings 113 are rotated to disengage the arms 113*a* from the top plate 101. Thereafter, the top plate 101 is rotated about the pin 112 into the folded position shown in FIG. 7. If desired, the toe link 106 may be outstretched to ensure the stability of the folded desk.

There may be provided an auxiliary leg the length of which is adjustable, or the auxiliary leg may be omitted where the top plate can be retained in a stable state simply by outstretching the base frame 106. It is also possible to omit the casters 114*b* and to project the casters 114*a* forward or in a direction away from the foot pipes 106*a* to let the caster wheels run on the same level as the sole or undersides of the foot pipes 106*a*.

Figure 9:
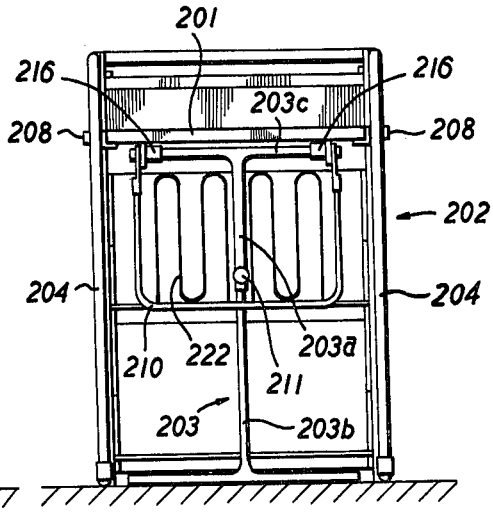
FIG. 9 is a side view of the desk of FIG. 8.
Figure 8:
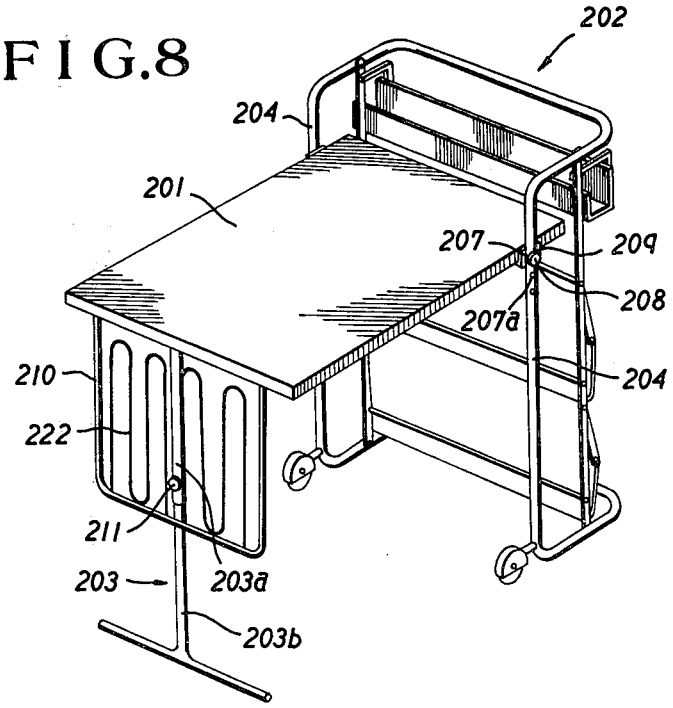
FIG. 8 is a perspective view of another embodiment of the present invention.

Referring to FIGS. 8 through 14, there is shown an embodiment with main and auxiliary legs 203 and 210 at the fore end of a top plate 201, the main leg 203 consisting of telescopically connected upper and lower pipes 203*a* and 203*b* which are fixed in a suitable length by a screw 211. As shown in FIG. 9, the upper pipe 203*a* of the main leg 203 has at its upper end a transversely extending support rod 203*c* the opposite ends of which are rotatably fitted in bearings 216 which are fixed on the underside of the top plate 201. The support frame 202 is provided with a row of through holes 207*a* at the pivotal support portion of each vertical frame 204 to allow adjustment of the level of the screw members 208 to be threaded into metal attachments 209 at opposite sides of the top plate 201. The top plate 201 can thus be supported at a number of different heights by threading the screw member 208 into the through holes 207*a* of different levels. In this connection, the lowest one of the through holes 207*a* has to be located at such a level that the fore end of the top plate which is supported at the lowest level will not hit on the floor surface when folding the desk.

Figure 10:
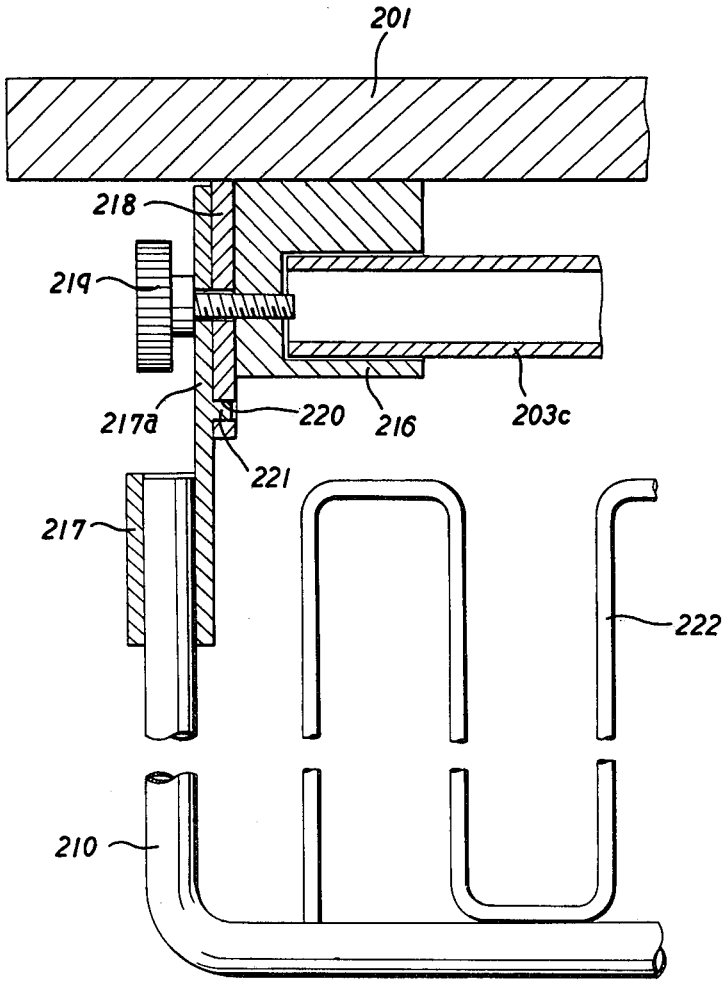
FIGS. 10 and 11 are enlarged sectional view and a front view showing the manner in which an auxiliary leg is attached to the top plate.
Figure 11:
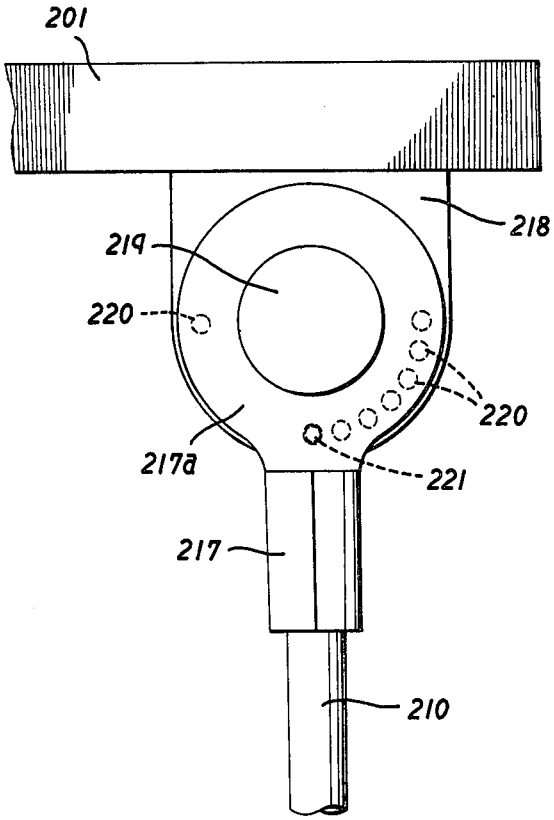

The auxiliary leg 210 consists of a U-shaped metal pipe which has a height shorter than the length of the main leg 203. As shown in FIGS. 10 and 11, the auxiliary leg 210 has a mounting plate 217 securely fixed each end thereof, the mounting plate 217 having a disk-like connecting portion 217*a* abutted against and clamped by a screw bolt 219 to a stopper plate 218 which is fixed on the underside of the top plate 201. Upon loosening the screw bolt 219, the auxiliary leg 210 can be rotated into an arbitrary tilted position relative to the top plate 201. The stopper plate 218 is provided with a number of stopper holes 220 which are arranged on a circular arc about the screw bolt 219. On the other hand, the mounting plate 217 is provided with a locking projection 221 in the lower middle portion of the connecting portion 217*a*. The locking projection 221 engages with one of the stopper holes 220 to hold the auxiliary leg 210 fixedly in an arbitrary tilted position. If desired, the locking projection 221 may be provided on the stopper plate 218 while providing the stopper holes 220 in the connecting portion 217*a*.

The auxiliary leg 210 has a height slightly longer than the upper pipe 203*a* of the main leg 203 and is provided with a wire grille 222 which covers the opening of the auxiliary leg 210 except upper end and middle portions thereof.

Figure 12:
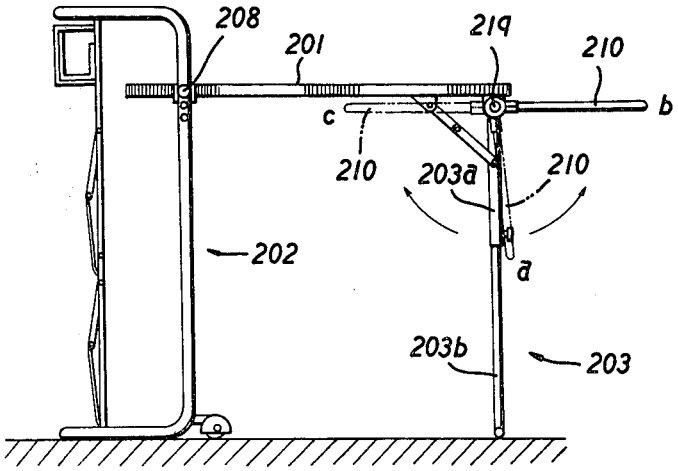
FIGS. 12 and 13 are side views showing the desk of FIG. 8 set up in two different forms.

When the above-described desk is used as an ordinary desk, the auxiliary leg 210 may be held either in the position a of FIG. 12 extending along the main leg 203, or in the position b projected horizontally on the outer side of the top plate 201 or in the position c folded along the underside of the top plate 201. When the auxiliary leg 210 is held in the horizontally projected position b, one can put papers or books on the wire grille 222 and can afford a working space ampler than the actual dimentions of the top plate 201. In order to fold the auxiliary leg 210 onto the underside of the top plate 201, lower pipe 203*b* of the main leg 203 is extracted and the auxiliary leg 210 is turned inward past the lower end of the upper pipe 203*a* which is shorter than the auxiliary leg 210. This folding action is not hindered by the wire grille 222 since the upper end and middle portions of the auxiliary leg 210 is left blank as mentioned hereinbefore. Otherwise, the wire grille 222 blocks the folding of the auxiliary leg 210 by hitting against the upper pipe 203*a* or the horizontal support rod 203*c* of the main leg 203.

Figure 13:
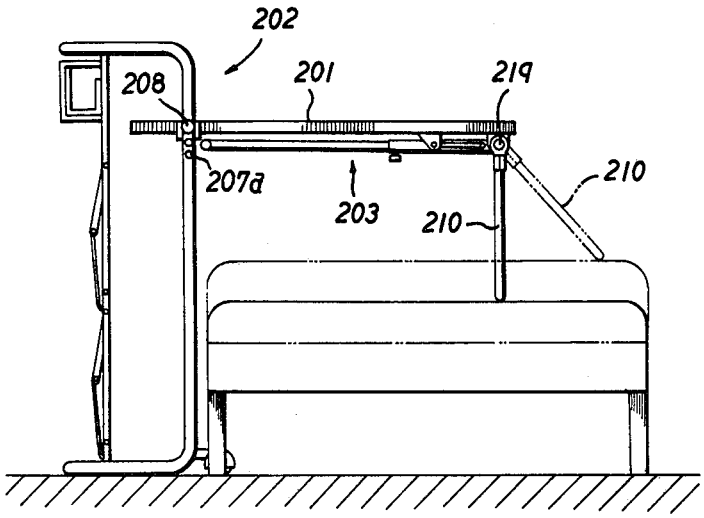

When the main leg 203 is folded onto the underside of the top plate 201 and only the auxiliary leg 210 is used to form a bed desk as shown in FIG. 13, the screw bolt 219 which clamps the connecting portion 217*a* of the auxiliary leg 210 is loosened to adjust the height of the auxiliary leg 210. For this purpose, the loosened auxiliary leg 210 is tilted or rotated about the screw bolt 219 through a suitable angle until a desired height, the locking projection 221 is engaged with one of the stopper holes 220 and the screw bolt 219 is tightened again.

The height of the top plate 201 at its base end is also adjustable by mounting the base end on the support frame 202 through mounting holes 207 at a desired level.

Figure 14:
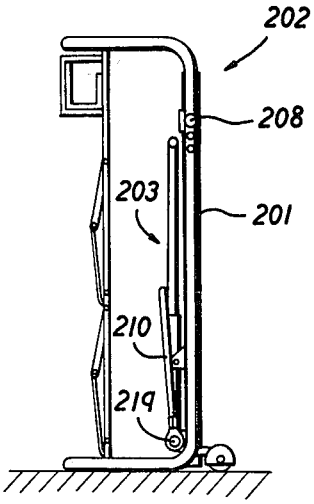
FIG. 14 is a side view of the desk of FIG. 8 as in folded state.

When the desk is not used, the main and auxiliary legs 203 and 210 are the underside of the top plate 201 as shown in FIG. 14 and the top plate 201 is rotated about the screw member 208 into the folded vertical position.

While, particular embodiments of the invention have been shown and described, various modification thereof will be obvious to those skilled in the art and therefore it should be understood that the invention is not limited to the disclosed embodiments or to the details thereof and includes all the modifications as encompassed by the scope of the appended claims.

What is claimed is:

1. A foldable desk comprising:

a support frame comprising a bent pipe having a pair of riser portions erected in parallel relation on a base portion and provided with pivotal support portions in the upper portions of said riser portions;

a top plate comprising a single rectangular plate of a length greater than the height of said pivotal support portions from a floor surface and swingably supported on said pivotal support portions to have a pivotal line across the width and at a position closer to the base end thereof, said pivotal line defining a swinging length of said top plate slightly shorter than the height of said pivotal support portions; and a leg member having the upper end thereof swingably connected to the underside of said top plate at the outer free end thereof;

said leg member being folded onto the underside of said top plate when the outer free end of said top plate is rotated downwardly about said pivotal line into a vertical folded position.

2. A foldable desk as defined in claim 1, wherein said base portion of said support frame is provided with casters projected toward said leg member and having wheels which are rotatable on a level with the sole of said base portion.

3. A foldable desk as defined in claim 1, wherein said base portion of said support frame comprising telescopically connected members which are stretchable or shrinkable toward and away from said leg member.

4. A foldable desk as defined in claim 3, wherein said base portion of said support frame is provided with casters on the underside thereof.

5. A foldable desk as defined in claim 1, wherein said top plate has metal attachments secured to the pivotally supported points at opposite sides thereof, said metal attachments each having crossed grooves on the outer side thereof and being centrally provided with a tapped hole for receiving a pivoting screw member.

6. A foldable desk as defined in claim 1, further comprising means for adjusting the height of said top plate.

7. A foldable desk as defined in claim 6, wherein said means for adjusting the height of said top plate includes a row of through holes provided in vertical alignment on each one of said riser portions of said support frame to receive a pivoting screw at different levels, and means for telescopically stretching or shrinking said leg member to a desired length.

8. A foldable desk as defined in claim 6, wherein said height adjusting means includes a level adjusting ring slidably fitted on each one of said riser portions and having a bracket for supporting said top plate, and means for telescopically stretching or shrinking said leg member to a desired length.

9. A foldable desk as defined in claim 1, wherein said top plate is provided at said outer free end with a foldable auxiliary leg in addition to and shorter than said leg member.

10. A foldable desk as defined in claim 9, wherein said auxiliary leg is formed substantially in U-shape and has the opposite ends thereof swingably connected through screws to stopper plates fixed on the underside of said top plate, said auxiliary leg being lockable in an arbitrary tilted position by engagement of a locking projection with one of stopper holes provided on either said stopper plate or the connecting end of said auxiliary leg.

11. A foldable desk as defined in claim 1, further comprising a bottom plate bridged between opposite sides of said base portion to provide a space for receiving a folded chair behind said top plate in folded state of the desk.

12. A foldable desk comprising:

a support frame having a pair of riser portions erected in parallel relation on a base portion and provided with pivotal support portions in the upper portions of said riser portions;

a top plate comprising a single rectangular plate of a length greater than the height of said pivotal support portions from a floor surface and swingably supported on said pivotal support portions to have a pivotal line across the width and at a position closer to the base end thereof, said pivotal line defining a swinging length of said top plate slightly shorter than the height of said pivotal support portions;

metal attachments secured to the top plate and to the pivotal support portions, said metal attachments each having crossed grooves on the outer side thereof and being centrally provided with a tapped hole for receiving a pivoting screw member; and a leg member having the upper end thereof swingably connected to the underside of said top plate at the outer free end thereof, said leg member being folded onto the underside of said top plate when the outer free end of said top plate is rotated about said pivotal line into a vertical folded position.

13. A foldable desk comprising:

a support frame having a pair of riser portions erected in parallel relation on a base portion and provided with pivotal support portions in the upper portions of said riser portions;

a top plate comprising a single rectangular plate of a length greater than the height of said pivotal support portions from a floor surface and swingably supported on said pivotal support portions to have a pivotal line across the width and at a position closer to the base end thereof, said pivotal line defining a swinging length of said top plate slightly shorter than the height of said pivotal support portions;

a leg member having the upper end thereof swingably connected to the underside of said top plate at the outer free end thereof, said leg member being folded onto the underside of said top plate when the outer free end of said top plate is rotated about said pivotal line into a vertical folded position; and means for adjusting the height of said top plate including a row of through holes provided in vertical alignment on each one of said riser portions of said support frame to receive a pivoting screw at different levels, and means for telescopically stretching or shrinking said leg member to a desired length.

14. A foldable desk comprising:

a support frame having a pair of riser portions erected in parallel relation on a base portion and provided with pivotal support portions in the upper portions of said riser portions;

a top plate comprising a single rectangular plate of a length greater than the height of said pivotal support portions from a floor surface and swingably supported on said pivotal support portions to have a pivotal line across the width and at a position closer to the base end thereof, said pivotal line defining a swinging length of said top plate slightly shorter than the height of said pivotal support portions;

a leg member having the upper end thereof swingably connected to the underside of said top plate at the outer free end thereof, said leg member being folded on to the underside of said top plate when the outer free end of said top plate is rotated about said pivotal line into a vertical folded position;

means for adjusting the height of said top plate including a level adjusting ring slidably fitted on each one of said rising portions and having a bracket for supporting said top plate, and means for telescopically stretching or shrinking said leg member to a desired length.

* * * * *